US007102623B2

(12) United States Patent
Morath

(10) Patent No.: US 7,102,623 B2
(45) Date of Patent: Sep. 5, 2006

(54) CONTROL PANEL

(75) Inventor: Erwin Morath, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 302 days.

(21) Appl. No.: 10/431,099

(22) Filed: May 7, 2003

(65) Prior Publication Data

US 2003/0214487 A1 Nov. 20, 2003

(30) Foreign Application Priority Data

May 16, 2002 (DE) ..... 202 07 722 U

(51) Int. Cl.
*G09G 5/00* (2006.01)

(52) U.S. Cl. ..... 345/173; 345/172

(58) Field of Classification Search ..... 345/156, 345/169, 176, 158, 168, 170, 172; 340/685, 340/686, 631.1; 701/50, 207, 300, 29, 34; 342/357; 172/2, 9; 37/348
See application file for complete search history.

(56) References Cited

U.S. PATENT DOCUMENTS 5,645,181 A * 7/1997 Ichiba et al. ..... 212/281
5,730,305 A * 3/1998 Ichiba et al. ..... 212/276
6,131,062 A * 10/2000 Nielsen ..... 701/50
6,643,576 B1 * 11/2003 O Connor et al. ..... 701/50
6,671,600 B1 * 12/2003 Hintzy ..... 701/50
6,744,372 B1 * 6/2004 Shaw et al. ..... 340/685
2003/0040865 A1 * 2/2003 Rigazio et al. ..... 701/207
2005/0017867 A1 * 1/2005 Shaw et al. ..... 340/601

FOREIGN PATENT DOCUMENTS

DE 201 00 168 U1 1/2002

* cited by examiner

*Primary Examiner*—Bipin Shalwala
*Assistant Examiner*—Nitin Patel
(74) *Attorney, Agent, or Firm*—Carter, DeLuca, Farrell & Schmidt, LLP

(57) ABSTRACT

The invention relates to a control panel for construction equipment and/or cranes, preferably vehicle cranes, with a series of manually operable switches for triggering certain functions and control functions of the machine to be operated. In terms of the invention, the switch is formed on a touch-sensitive panel (touch-screen).

6 Claims, 1 Drawing Sheet

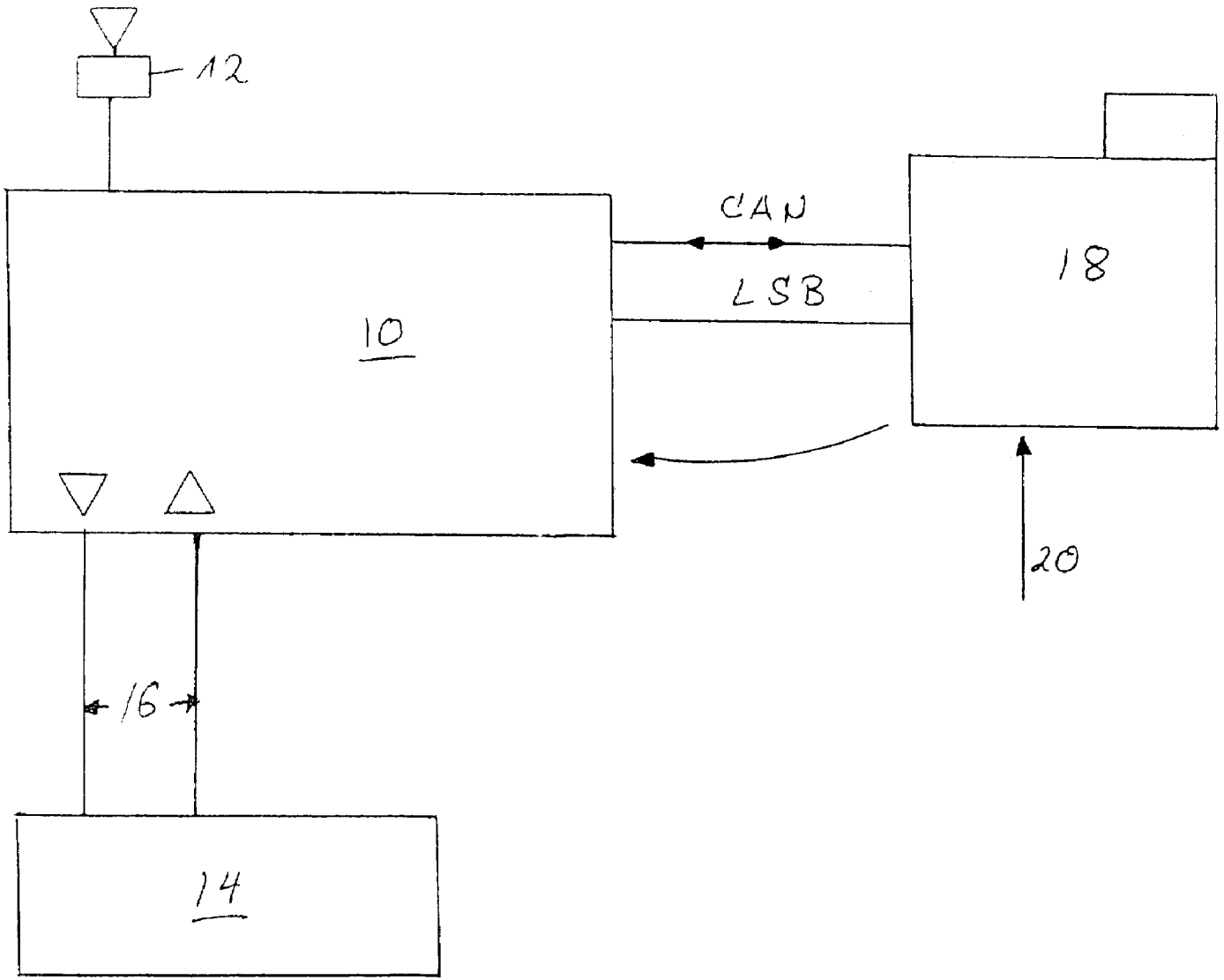
18
20
CAN
LSB
10
12
16
14

CONTROL PANEL

BACKGROUND

1. Technical Field

The invention relates to a control panel for construction equipment and/or cranes, preferably mobile cranes, with a series of manually operated switches for triggering certain functions and control functions of the machine to be operated.

2. Description of Related Art

In principle, these control panels are known, for example from the DE 201 00 168 U. There, push buttons are provided as manually operated switches, said buttons each being part of a foil-covered keyboard. Thus, in a clearly defined manner, certain buttons have been given corresponding functions or control functions. If particular buttons of the foil-covered keyboard are to be given new functions, the buttons must be provided with new lettering which requires the exchange of the entire keyboard or expensive re-fitting work.

It is the object of the invention to further develop a generic control panel such that correlating the manually operated switches to certain functions can be modified without any problems.

SUMMARY

In terms of the invention and based on the state of the art, this object is solved in that the switches are formed on a touch-sensitive panel, a so-called touch-screen. By suitable programming, any desired function buttons can be placed at relevant spots under the touch-screen so that, with a re-programming of the relevant function buttons, new lettering can be stored for the desired spot of the touch-screen without any further rework.

BRIEF DESCRIPTION OF THE DRAWING

FIG. 1 is a schematic drawing showing a control panel as described herein, data lines, a voice output device, actuators for a crane and connections to a host computer.

DETAILED DESCRIPTION

Details and advantages of the invention result from the subordinate claims following the main claim.

Thus, the control panel advantageously can have its own control computer.

The control computer of the control panel, which is mounted in a driver's cabin of a vehicle crane for example, can be connected with the host computer of the main machine via one or more bus systems.

The control panel can advantageously also be connected with a voice output device.

On the touch-screen, the relevant switch symbols can be stored via the control computer of the control panel.

An especially advantageous design includes that the control panel consists of a pure input device with a touch-screen and a cabin computer, namely the control computer which is placed in the driver cabin of the vehicle crane for example, with the input device being designed as a portable device. Furthermore, the input device can be connected to the cabin computer via a blue tooth connection.

Further details and advantages of the invention are explained further with the aid of an embodiment illustrated in the drawing.

The only FIGURE shows the schematic structure of an embodiment of the control panel in terms of the invention.

The control panel is shown here as a block unit 10. In this case, it has a so-called touch-screen which is not shown and which is controlled by a self-contained control computer built into the block unit 10. By this control computer, the symbols associated with the relevant switch are generated on the touch-screen. If it is desired to allocate a new function to a certain switch or a certain push button, it can be generated easily via this control computer. Thus, it is always possible to display on the touch-screen the currently required symbols or lettering for the control functions to be implemented.

With the control panel presented here, a definite operating sequence of a vehicle crane, for example, can be worked through by the crane driver as follows. For a certain task initialised via the touch-screen by contacting a relevant spot, a certain sequence of switching elements can be displayed on the touch-screen whereby, for a certain task to be performed, said sequence has to be followed through point by point. Such a task can, for example, be the assembly or disassembly of a crane vehicle component such as a luffing point.

For ease of operation when selecting functions, the next push button to be operated can each time be blinking. The function presented is only confirmed and carried out by pressing the push button, which is then made clear by the end of blinking and the pressed button or pressed switch on the touch-screen being lit up permanently. A confirmation of the switch having been operated can also take place by a suitable change of colour of the stored symbol or the lettering, and an acoustic signal.

The control panel 10 can be combined with a voice output device 12 via which relevant commands or information can be conveyed to the operators in the driver's cabin. The number 14 represents the relevant actuators of the vehicle crane, which are connected to the control panel 10 via suitable data lines 16. The control computer of the control panel 10 is connected to a host computer 18 via a field bus, for example a CAN-bus and an LSB-bus. All the software that can be downloaded by the control computer of the control panel 10 is stored on the host computer 18.

What is claimed is:

1. A control panel for construction equipment with a series of manually operable switches for triggering certain functions and control functions of the equipment to be operated, comprising a touch sensitive display panel screen wherein said switches are formed and displayed as symbols on the screen via a control computer which is capable of altering the appearance or function of the symbols.

2. The control panel according to claim 1, wherein the control panel contains its own control computer.

3. The control panel according to claim 2, wherein the control computer is connected to a host computer of the equipment via one or more bus systems.

4. The control panel according to claim 1, wherein the control panel is connected to a voice output device.

5. The control panel according to claim 1 wherein the control panel is divided into a pure input device with a touch-sensitive panel and a cabin computer whereby the input device is formed as a portable device.

6. The control panel according to claim 5, wherein the input device is connected to the cabin computer via a blue tooth connection.

* * * * *